United States Patent [19]

Meier et al.

[11] 4,296,702

[45] Oct. 27, 1981

[54] STORAGE COMPARTMENT FOR SEWING MACHINE FOOT CONTROLLER

[75] Inventors: Willi Meier, Karlsruhe-Durlach; Bernd Rojahn, Herxheim, both of Fed. Rep. of Germany

[73] Assignee: Dorina Nähmaschinen GmbH, Fed. Rep. of Germany

[21] Appl. No.: 21,834

[22] Filed: Mar. 19, 1979

[30] Foreign Application Priority Data

Mar. 23, 1978 [DE] Fed. Rep. of Germany ... 7808896[U]

[51] Int. Cl.[3] ..... D05B 69/10; D05B 75/00

[52] U.S. Cl. ..... 112/258

[58] Field of Search ..... 112/220, 271, 258, 260, 112/217.1, 217.3; 242/107 R, 107.6, 107.7, 107.12; 312/208

[56] References Cited

U.S. PATENT DOCUMENTS

| | | | |
|---|---|---|---|
| 1,344,718 | 6/1920 | Riddell | 312/208 |
| 1,443,993 | 2/1923 | Koster | 242/107 R |
| 2,796,036 | 6/1957 | Fuller et al. | 112/258 |
| 3,013,514 | 12/1961 | Stanton | 112/260 |
| 3,141,429 | 7/1964 | Momberg et al. | 112/220 |
| 3,330,237 | 7/1967 | McGann, Jr. | 112/258 |
| 3,673,972 | 7/1972 | Grange | 112/258 |
| 4,067,255 | 1/1978 | Camaioni | 242/107.6 |
| 4,098,206 | 7/1978 | Suchsland et al. | 112/220 |
| 4,114,736 | 9/1978 | Scherenberg | 242/107.6 |

FOREIGN PATENT DOCUMENTS

| | | | |
|---|---|---|---|
| 1190482 | 5/1970 | United Kingdom | 112/220 |

*Primary Examiner*—Werner H. Schroeder
*Assistant Examiner*—Andrew M. Falik
*Attorney, Agent, or Firm*—McGlew and Tuttle

[57] ABSTRACT

An electric sewing machine comprises a casing with an electric drive motor mounted in the casing. The casing includes a recess defined in the base portion which opens on one end and receives a control member which fits in the recess. The control member carries a control for regulating the speed of the motor which includes a foot-pedal switch for operating a variable resistance to change the motor speed. The control member includes a reel over which a connecting cable is wound and which extends between the control in the housing of the control member through the casing to the motor. A winding mechanism permits the control member to be removed from the recess of the casing by permitting the unwinding of the cable without disconnecting it from the control. The winding mechanism includes a reel which is unwound with the cable and a spring for returning the reel when the cable is to be rewound for replacement of the control into the housing. Detent mechanisms associated with the reel permit the locking of the reel when the control member is removed from the recess by the amount of cable necessary to position it in a desired control position. The locking mechanism may be unlocked by pulling the connecting line slightly to release the detent means and permit the rewinding of the connecting cable on the reel during the replacement of the control member into the recess.

10 Claims, 3 Drawing Figures

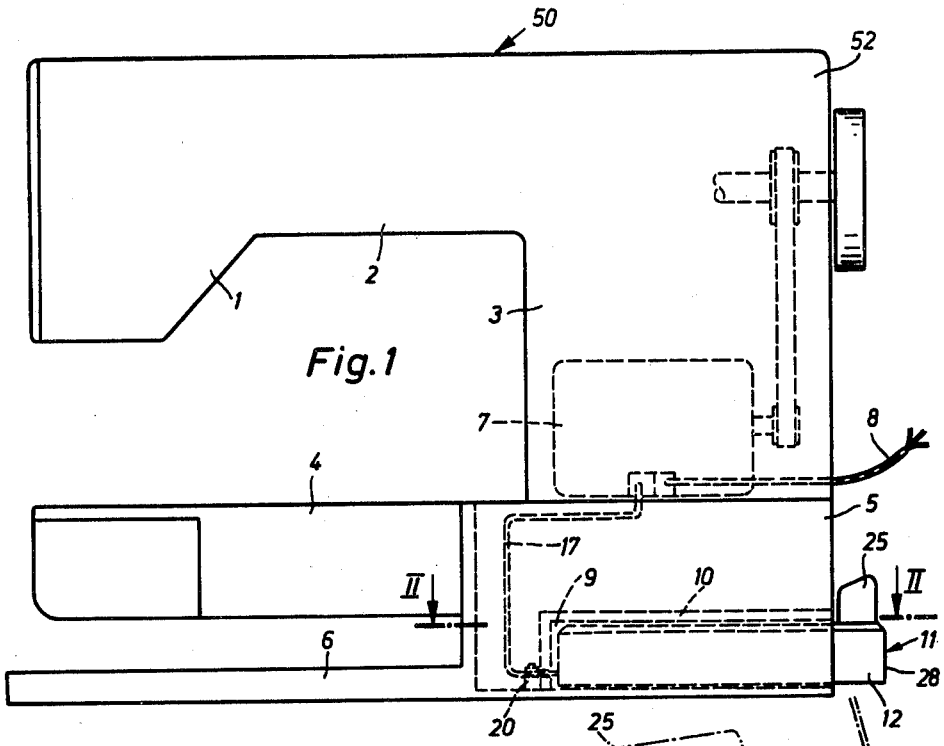
Fig. 1
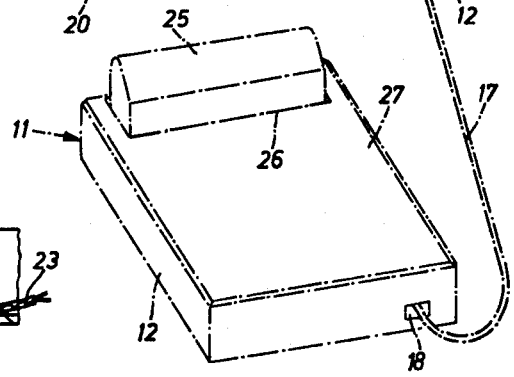
Fig. 3
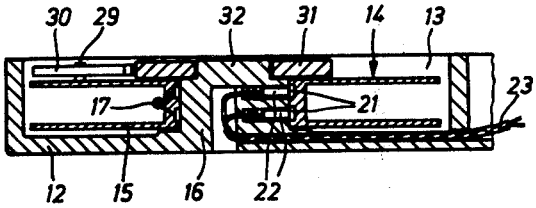
Fig. 2
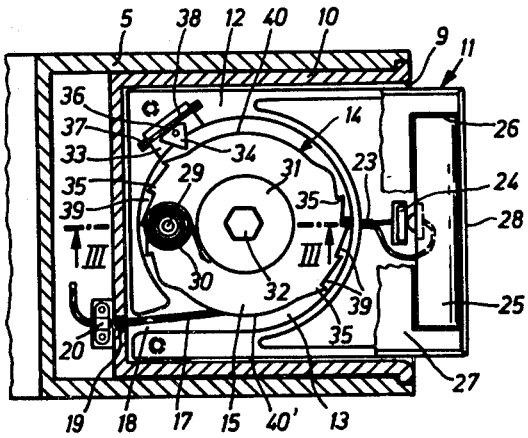

STORAGE COMPARTMENT FOR SEWING MACHINE FOOT CONTROLLER

BACKGROUND OF THE INVENTION

1. Field of the Invention

The invention relates in general to sewing machines and in particular to a new and useful sewing machine having an electric drive motor which is controlled by a control member received in a recess of the sewing machine casing and is connected to the drive member by a cable which remains connected to a control in the control member housing which may be unwound during the removal of the control member housing from the casing of the machine.

2. Description of the Prior Art

In the presently known sewing machines it is difficult to accommodate a control device for such machines in a suitable manner when it is not in use. Particularly when the sewing machine is stored in a carrying case, the control device is often secured on the inside of the case such that it protrudes between the upper and lower arm of the sewing machine in the carrying case. With onepart covers, which are generally adapted to fit over the top of the sewing machine, such fastening is not possible. Here the control device is typically placed loosely on the lower arm of the sewing machine. When the machine is carried, it can thus slide back and forth and damage the surface of the machine or the needle bar or parts of the cloth presser.

The electric cable connecting the control device with the sewing machine presents additional difficulties in accommodating the control device. A sewing machine which is already known has a storage space for inserting the cable between the control device and the motor, but this space must be large, not only in length and width, but also in height in order to receive a hand-wound cable and to accommodate the cable plug so that the direct accommodating of the control device in the sewing machine casing would be technically impossible.

SUMMARY OF THE INVENTION

In order to avoid these drawbacks, the invention provides a better menas for accommodating the control device, and solves the forementioned problem by providing in the casing of the machine a recess for receiving the control device.

An additional object of the invention is therefore to provide advantageous accommodation of the cable inside the control device.

This problem is solved in this way, that the cable is wound on a winding reel, locked in known manner, and which is arranged inside the housing for the control device. In the, inventive design, the housing of the control device is a stationary part of the winding reel and the overall height of the control device is very low, so that it can be accommodated in a flat recess provided in the casing of the sewing machine, whose low height is determined by the driving parts arranged in the casing of the sewing machine.

The control device can be preferably so designed that its housing has, in the immediate proximity of the side wall opposite the exit of the cable, an opening from which protrudes an operating member for the control element of the control device. In this way the control device has a predominantly flat portion that can be inserted into the recess of the machine, and a relatively high portion which can serve as a limiting stop during the insertion.

Accordingly, it is an object of the invention to provide a sewing machine which comprises a casing with a drive motor mounted on the casing with a recess defined in the casing which accommodates a control member for the motor wherein the control member includes a housing positionable in the recess and a control in the housing and a cable connected from the control through the housing to the motor, and with winding means in the housing over which the cable is wound which permits unwinding of the cable when the control member is removed from the recess of the casing without disconnecting the cable from the control in the motor.

A further object of the invention is to provide a sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the Drawings:

FIG. 1 is a front elevational view of a sewing machine having a control device represented in the inserted operating state by broken lines and constructed in accordance with the invention;

FIG. 2 is a section taken along the line II—II of FIG. 1; and

FIG. 3 is a section through the control device taken along line III—III of FIG. 2 and on an enlarged scale.

GENERAL DESCRIPTION OF THE PREFERRED EMBODIMENT

Referring to the drawings in particular, the invention embodied therein comprises a sewing machine generally designated 50 which has a casing 52 which includes a head portion 1 of a sewing arm 2 which is connected to the upper end of a stand 3 which includes a lower arm 4 connected to the lower end of the stand 3. The casing 52 includes a bottom plate 6 having a recess 9 for a control member or a control device 11 for regulating the speed of a drive motor 7 of the sewing machine. The control device 11 is connected to the motor 7 by a connecting cable 17 which is stored in a housing 12 of the control member 11 on winding means or a winding reel storage means generally designated 14. Cable 17 remains connected to the motor 7 when the control member 11 is in recess 9 of the casing 52 or when it is withdrawn out of the casing to a place at which it will be used for control, during which time the cable 17 is unwound from the winding means 14. The control member 11 may be replaced into the recess 9 and the cable automatically wound on the winding means 14 during the process.

This sewing machine represented in FIG. 1 comprises a head 1, upper arm 2, stand 3, lower arm 4, and base 5 with bottom plate 6. In stand 3 is installed driving motor 7 for the sewing machine which is supplied with current over power line 8.

Recess 9, in base 5, is open laterally and bonded thereto is an insert 10 consisting preferably of an impact-proof material alternatively the recess 9 can be lined with such a material. Recess 9 preferably serves to receive a control device 11 in the form of a pedal starter or foot controller for controlling the speed of driving motor 7.

Control device 11 has a bottom housing part 12 (FIG. 2 and 3), in which is provided a circular recess 13. Winding reel 14 is arranged in recess 13 and includes a cable drum 15 which is rotatably mounted on a bearing pin 16 that is arranged in recess 13 and rigidly connected with the bottom housing part 12. Cable drum 15 receives an electric cable 17 which projects from a slot 18 in bottom housing part 12 of control device 11 and which extends through an opening 19 in insert or cartridge 10 to driving motor 7. The part of cable 17 projecting through slot 18 is secured against axial pulls by a cable clamp 20 secured behind opening 19 in base 5.

Cable 17 is connected to line connections 22 over an electrical rotary coupling 21 disposed between bearing pin 16 and cable drum 15. The connections 22 are connected over a line 23 to the terminals of a variable resistance 24. Variable resistance 24 can be adjusted by the central device or foot controller 25 which projects from an opening 26. The opening 26 is provided in a cover plate 27 bolted with bottom housing part 12 in the immediate proximity of the side wall 28 opposite the exit of cable 17. Variable resistance 24 serves, in a known manner, to control the speed of driving motor 7 when foot controller 25 is pressed down by the foot of the operator.

On a pin 29 secured on cable drum 15 is wound a restoring rolling spring or return spring 30 whose extreme end is secured on the circumference of a disk 31 which is mounted transposably on a hexagonal pin 32 rigidly connected with bearing pin 16. Rolling spring 30 pulls cable drum 15 into the end position shown in FIG. 2 for biasing the winding reel in a direction to rewind the cable. When cable 17 is pulled off, rolling spring 30 is wound on disk 31 during the rotation of cable drum 15.

In a recess 33 of bottom housing part 12 a pawl 34 is pivotally mounted which cooperates with notches 35 which are provided on the circumference of the upper flange of cable drum 15. Pawl 34 forms together with notches 35 a directional ratchet mechanism.

Pawl 34 is provided with a surface 36 which presses on a leaf spring 38 held in slots 37 of bottom housing part 12. Leaf spring 38 acts as a bending rod which tries to force pawl 34 into its central position radially to the axis of rotation of cable drum 15.

Notches 35 are separated from each other by depressions 39. These are so flat that pawl 34 cannot be turned within its range into its radial position. At two points of the circumference of the upper flange of cable drum 15, segments 40,40' are provided which extend through a wide angle and whose radius is so selected that pawl 34 can assume its central radial position.

When control device 11 is removed from its recess 9 and correspondingly a pull is exerted on the part of cable 17 clamped in cable clamp 20, cable drum 15 turns clockwise in FIG. 2 about bearing pin 16, due to the pull exerted by cable 17. Notches 35 move beyond pawl 34 urged by leaf spring 38 toward the circumference of the upper flange of cable drum 15, which tilts in the range of notches 35 and depressions 39. Pawl 34 does not lock.

At the same time rolling spring 30 is wound by pin 29 on which it rests loosely by the rotation of cable drum 15 on disk 31. If a sufficient amount of cable has been pulled off from cable drum 15, the pull on cable 17 is stopped. Cable drum 15 thus turns counter-clockwise, due to the action of rolling spring 30. Pawl 34 bears on the respective inclines or notches 35, and as soon as it is opposite a depression 39 it prevents a further rotation of cable drum 15, so that cable 17 maintains its pulled-out position and control device 11 can be used to control the speed of driving motor 7.

After the sewing is completed, the directional ratchet mechanism consisting of the spring-loaded pawl 34 and notches 35 can be eliminated by moving pawl 34, by pulling on cable 17, to one of two diametrically opposite segments 40 and 40' defined on the circumference of the upper flange of cable drum 15, in which pawl 34 assumes its radial position by the action of leaf spring 38. When cable 17 is released, rolling spring 38 turns cable drum 15 counter-clockwise and is wound on pin 29. Pawl 34 assumes an inclined position and glides over notches 35 without locking. The action of the directional ratchet mechanism is eliminated in this inclined position of pawl 34.

Cable 17 is pulled into bottom housing part 12 and is wound on cable drum 15. Control device 1 can now be inserted into recess 9 in base 5 of the sewing machine with operating member 25 serving a stop.

While a specific embodiment of the invention has been shown and described in detail to illustrate the application of the principles of the invention, it will be understood that the invention may be embodied otherwise without departing from such principles.

What is claimed is:

1. A sewing machine comprising, a casing, a drive motor for driving said sewing machine mounted on said casing, a recess defined within said casing opening outwardly to one side thereof, a foot control member for said motor having a housing portion removably positionable in said recess and a control portion for regulating the speed of said motor in said housing portion, a cable fixedly attached to said casing and electrically interconnected with said control portion and said motor through said housing portion, a winding reel rotatably mounted in said housing portion about said control portion and having a drum portion around which at least part of said cable is wound, said winding reel rotatable with respect to said housing portion for winding and unwinding said cable to permit movement to said control member out said recess, and spring means mounted on said drum portion for biasing said winding reel in a direction to rewind said cable.

2. A sewing machine according to claim 1 wherein said winding reel includes a flange connected to said drum having a peripheral surface with a plurality of notches adjacent a smooth segment thereof, and further comprising detent means pivotably mounted in said housing portion for engaging said notches to lock said reel in a cable extended position when said control member is removed from the recess of said casing.

3. A sewing machine according to claim 2 wherein said detent means includes a substantially triangular detent member having a flat surface, a spring engaged against said flat surface, said detent member being pivotally mounted so that said flat surface may be moved against the spring to position said detent member either straight outwardly from said spring or at an angle relative thereto when said spring is tensioned, said detent member being lockable between said notches when said reel is unwound, said spring means comprising a coil spring carried by said reel, a disc having a perhiphery engaged with the end of said spring whereby said spring is unwound around said disc when said reel is unwound so as to tension said spring and the spring is returned to return said reel when the cable is released by said detent.

4. A sewing device according to claim 1 further comprising an insert of impact-proof material bonded to the sides of said recess.

5. A sewing machine, comprising a casing, a drive motor mounted on said casing, a recess defined within said casing, a foot control member for said motor including a housing portion with a control means therein, said foot control member being locatable in said recess to be removably positioned therein, a cable connected from said control means through said housing to said motor, winding means in said housing over which said cable is wound, permitting unwinding of said cable when said control member is removed from said recess of said casing without disconnecting said cable from said control means and said motor.

6. A sewing machine according to claim 5 wherein said winding means comprises a winding reel rotatably mounted in said housing.

7. A sewing machine according to claim 6, wherein said control comprises a speed control for said motor.

8. A sewing machine according to claim 7 wherein said speed control comprises a variable resistance mounted in said housing alongside said reel.

9. A sewing machine, comprising a casing, said casing including a portion defining a recess, a drive motor mounted on said casing, a foot control member for said motor including a housing portion, control means in said housing portion, said foot control member being locatable in said recess to be removably positioned therein, and a cable connected at its one end to said control means and extending to said housing and passing within the machine through said housing and said recess to be connected to said motor at its other end.

10. A sewing machine according to claim 9 wherein said sewing machine includes a stand portion, an upper supporting arm extending outwardly from the top of said stand portion and terminating in a sewing machine head, a lower arm below said upper arm having a base portion extending below said stand portion, the recess being defined within said base portion opening on one side thereof, said motor being supportable on said base portion in said stand portion, said cable being connected from said motor through said base portion to the recess and into said housing and including a cable clamp located on said sewing machine base portion within said recess engaged with said cable exiting from said housing.

* * * * *